US007811510B2

(12) United States Patent
Ura

(10) Patent No.: US 7,811,510 B2
(45) Date of Patent: Oct. 12, 2010

(54) CONTINUOUS CARBURIZING FURNACE

(75) Inventor: Satoru Ura, Tenri (JP)

(73) Assignee: Koyo Thermo Systems Co., Ltd., Nara (JP)

( * ) Notice: Subject to any disclaimer, the term of this patent is extended or adjusted under 35 U.S.C. 154(b) by 505 days.

(21) Appl. No.: 11/869,836

(22) Filed: Oct. 10, 2007

(65) Prior Publication Data

US 2008/0237946 A1 Oct. 2, 2008

(30) Foreign Application Priority Data

Mar. 30, 2007 (JP) ..... 2007-092719

(51) Int. Cl.
*C21C 1/06* (2006.01)

(52) U.S. Cl. ..... 266/252; 432/126

(58) Field of Classification Search ..... 266/251, 266/252; 432/126, 128
See application file for complete search history.

(56) References Cited

U.S. PATENT DOCUMENTS 5,443,383 A * 8/1995 Kuehn ..... 432/122

7,090,488 B2 * 8/2006 Murakami et al. ..... 432/128

FOREIGN PATENT DOCUMENTS

JP 2004-010945 1/2004

* cited by examiner

*Primary Examiner*—Scott Kastler
(74) *Attorney, Agent, or Firm*—Renner, Otto, Boisselle & Sklar, LLP

(57) ABSTRACT

A furnace includes a carburizing zone in which carburizing processing is performed upon workpieces loaded upon trays during the conveyance, and a plurality of regions which are arranged at the upstream side of the carburizing zone. Along with a tray upon which workpieces are loaded being mounted upon each one of the plurality of pallets, these pallets are movable along a linear conveyance direction, with the number of pallets being the same as the number of regions. The pusher device pushes the trays along the direction of conveyance. And the pusher-puller device, along with pushing the plurality of pallets all together forward along the direction of conveyance, also pulls one of the plurality of pallets backward into each of the plurality of regions.

5 Claims, 4 Drawing Sheets

CONTINUOUS CARBURIZING FURNACE

CROSS REFERENCE

This Nonprovisional application claims priority under 35 U.S.C. §119(a) on Patent Application No. 2007-092719 filed in Japan on Mar. 30, 2007, the entire contents of which are hereby incorporated by reference.

BACKGROUND OF THE INVENTION

The present invention relates to a continuous carburizing furnace which performs a plurality of processes, including a carburizing process, successively upon a workpiece which is being conveyed in an ambient atmosphere which includes a carburizing gas.

With a continuous carburizing furnace, a heating zone, a carburizing zone, a diffusion zone, a cooling zone, and so on are provided within the furnace. A workpiece which has been loaded upon a tray is subjected to processing in each of these zones, while the tray is conveyed from a transport entrance of the furnace towards a removal aperture thereof.

As methods for conveying the workpiece within the furnace, both the tray pusher method and the roller hearth method are available. With a continuous carburizing furnace which utilizes the tray pusher method, as for example disclosed in Japanese Laid-Open Patent Publication 2004-10945, a tray most to the upstream side is pushed by a pusher from the transport entrance towards the removal aperture, and thereby a plurality of trays are conveyed while being kept in mutual contact. On the other hand, with a continuous carburizing furnace which utilizes the roller hearth method, a large number of hearth rollers which are arranged across the floor of the furnace are rotationally driven, so that the trays are shifted over these hearth rollers.

It is necessary to apply mutually different levels of heating energy to the heating zone and to the carburizing zone within the furnace. Furthermore, the carburizing zone receives an input of a carburizing gas. In order to enhance the product quality of the workpiece after carburizing processing, it is necessary to keep the temperature and the ambient atmosphere in each zone constant; and, to this end, it has been contemplated to selectively isolate the heating zone, in which the temperature differences with the previous and successive zones are most conspicuous, with intermediate doors which are opened and closed as required.

With the roller hearth method, it is possible to adjust the gaps between the various trays in a simple and easy manner by controlling the rotation of the hearth rollers. Due to this, continuous carburizing furnaces which utilize the roller hearth method, and in which intermediate doors are installed between the heating zone and the carburizing zone, are nowadays widespread.

However, with a continuous carburizing furnace which utilizes the roller hearth method, it is necessary to drive the large number of hearth rollers from the exterior, and a considerable amount of thermal energy is wasted by thermal diffusion from the side walls of the furnace in which the shafts of the hearth rollers are supported. Furthermore, it becomes necessary to oscillate the hearth rollers by rotating them forwards and backwards cyclically in order to prevent deflection of the hearth rollers due to the loadings imposed upon them from the trays, so that the drive control of the rollers becomes troublesome. Moreover, the maintenance of this large number of hearth rollers also becomes complicated and troublesome. Yet further, the size of the furnace is increased due to the provision of the gaps between the plurality of trays.

On the other hand, with a continuous carburizing furnace which utilizes the tray pusher method, it is possible to eliminate the above described shortcomings of the roller hearth method; and, by changing the stroke of the pusher, it is possible to provide a gap between the tray which is most towards the upstream side and the tray in front of it. However, a purge chamber which is provided with an intermediate door between itself and the heating zone is present at the transport entrance side of the furnace, and it is not possible to bring in the next tray to this purge chamber until the previous tray has been conveyed from the heating zone to the carburizing zone, so that the time period between bringing in trays becomes long.

Moreover, by providing a plurality of pushers whose pushing angles in plan view are mutually orthogonal, and by changing the direction of conveyance of the trays within the furnace in a zigzag manner, it is possible to create a gap between a pair of trays, during their conveyance through the furnace. However, in this case, the shape of the furnace in plan view cannot be made to be linear, so that the area which the device occupies is increased in size.

The objective of the present invention is to supply a continuous carburizing furnace which operates according to the tray pusher method, with which it is possible to install intermediate doors between successive ones of a plurality of regions which are provided in succession at the upstream side of a carburizing zone, while maintaining the shape in plan view of the conveyance path as being a straight line.

SUMMARY OF THE INVENTION

The present invention includes a furnace, a plurality of pallets, a pusher device, and a pusher-puller device. The furnace includes a carburizing zone in which carburizing processing is performed upon workpieces loaded upon trays during the conveyance of the trays along a direction of conveyance, and a plurality of regions which are arranged successively along the direction of conveyance at the upstream side of the carburizing zone. Along with a tray upon which workpieces are loaded being mounted upon each one of the plurality of pallets, these pallets are movable along a linear conveyance direction, with the number of pallets being the same as the number of regions. The pusher device pushes the trays along the direction of conveyance. And the pusher-puller device, along with pushing the plurality of pallets all together forward along the direction of conveyance, also pulls one of the plurality of pallets backward into each of the plurality of regions.

DETAILED DESCRIPTION OF THE INVENTION

Figure 1:
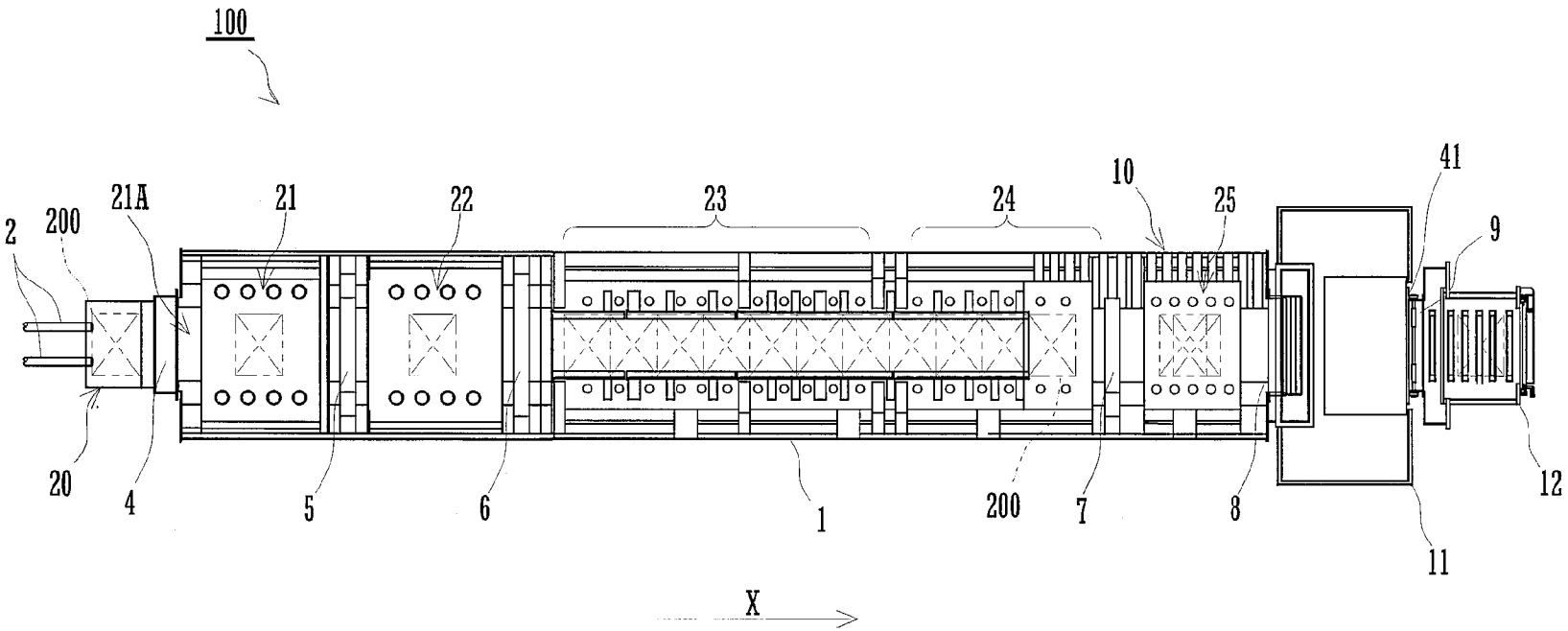
FIG. 1 is a plan sectional view of a continuous carburizing furnace according to an embodiment of the present invention.
Figure 2:
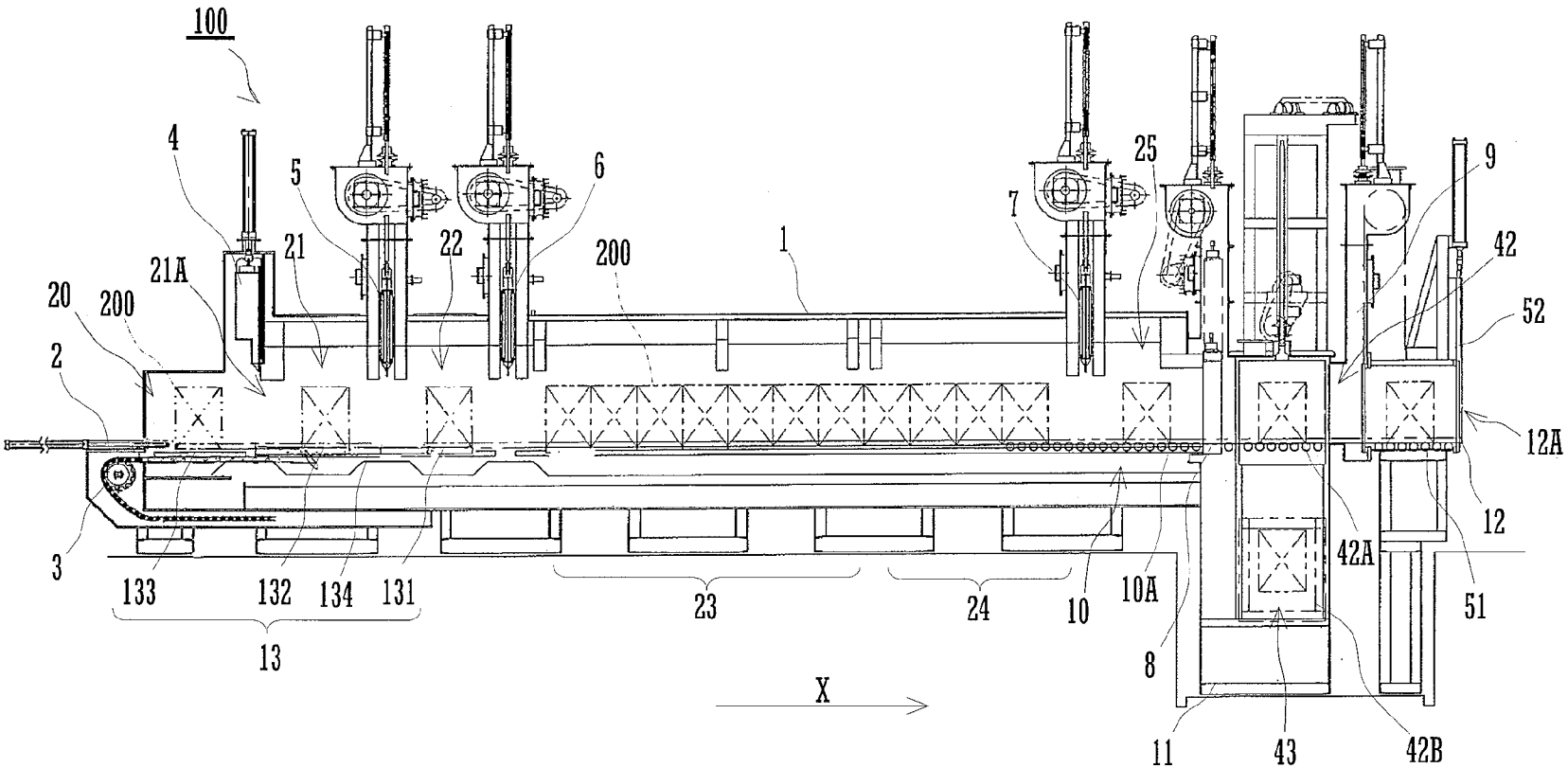
FIG. 2 is a side sectional view of this continuous carburizing furnace.

FIG. 1 is a plane sectional view showing an example of a continuous carburizing furnace according to an embodiment of the present invention. And FIG. 2 is a side sectional view of this continuous carburizing furnace.

This continuous carburizing furnace 100 continuously performs, as one example, pre-processing, heating processing, carburizing processing, diffusion processing, cooling processing, and quenching processing upon workpieces which are loaded upon each of trays during conveyance along a conveyance path which is shaped as a straight line in plan view. This continuous carburizing furnace 100 is a continuous carburizing furnace employing a hybrid method, and conveys trays which are loaded with a large number of workpieces through pre-processing, heating processing, carburizing processing, and diffusion processing by a tray pusher method, and then conveys them through cooling processing and quenching processing by a roller hearth method. And this continuous carburizing furnace 100 comprises a furnace main body 1, a pusher device 2, a pusher-puller device 3, intermediate doors 4 through 8, a removal door 9, a roller hearth 10, a quenching device 11, a removal device 12, and a pallet device 13.

The furnace main body 1 is the "furnace" of the Claims, and, in plan view, is made as a rectangle of approximately constant width, extending along the direction of conveyance of trays 200, as shown by an arrow sign X. An introduction chamber 20, a purge chamber 21, a heating chamber 22, a carburizing zone 23, a diffusion zone 24, and a cooling zone 25 are arranged in that order in the furnace main body 1, along the direction of the arrow sign X. The introduction chamber 20, the purge chamber 21, and the heating chamber 22 correspond to the "plurality of regions" of the Claims.

In the introduction chamber 20, there is disposed a tray 200 upon which is loaded workpieces which are next to be subjected to carburizing processing. In this example, in the purge chamber 21, heat at approximately 400° C. is applied to workpieces which are loaded upon a tray 200 in an ambient atmosphere which has been isolated from the external air, and pre-processing such as oil removal processing and so on is performed thereupon.

The purge chamber 21 is not to be considered as being limited by the above; any configuration will be acceptable, provided that it is one with which it is possible to replace the ambient atmosphere therein.

In the heating chamber 22, workpieces are subjected to preliminary heat application at approximately 900° C. in an ambient atmosphere of a carrier gas such as RX gas or the like.

In the carburizing zone 23, a carrier gas such as RX gas or the like and an enrichment gas such as a hydrocarbon gas or the like are supplied, and carburizing processing is performed by applying heat to each of workpieces at approximately 930° C. to 950° C. in an ambient atmosphere of carburizing gas.

In the diffusion zone 24, diffusion processing is performed, in order to diffuse the carbon which has been loaded by the carburizing processing onto the surface of each of workpieces, into the interior of each of workpieces.

In the cooling zone 25, workpieces are cooled and soaked to a temperature of approximately 850° C., which is the temperature before the start of quenching processing.

The pallet device 13 consists of three pallets 131 through 133 and a rail 134. The length in the direction of conveyance X of each of these pallets 131 through 133 is approximately the same as that of the tray 200. Each of these pallets 131 through 133 is independently movable. The rails 134 is continuously extended from the introduction chamber 20 through the purge chamber 21 and the heating chamber 22 to a portion of the carburizing zone 23, with their longitudinal directions parallel to the direction of conveyance X. The rail 124 regulates the direction of shifting of the pallets 131 through 133. I.e., the pallets 131 through 133 are shifted to and fro along the direction of conveyance X, while being guided by the rail 134.

The pusher device 2 pushes a total of three trays 200 which are mounted upon the pallets 131 through 133 all together in the direction of the arrow sign X.

The pusher-puller device 3 is disposed beneath the pusher device 2. This pusher-puller device 3, along with pushing the pallets 131 through 133 all together in the direction of conveyance X, also pulls each of the pallets 131 through 133 back through the heating chamber 22 and the purge chamber 21 to the introduction chamber 20.

The intermediate doors 4 through 6 are the plurality of intermediate doors of the Claims. The intermediate door 5 opens and closes between the purge chamber 21 and the heating chamber 22. The intermediate door 6 opens and closes between the heating chamber 22 and the carburizing zone 23. And the intermediate door 4 opens and closes a transport entrance 21A between the introduction chamber 20 and the purge chamber 21.

Due to these intermediate doors 5 and 6, it is possible selectively to mutually isolate the purge chamber 21 and the heating chamber 22, and the heating chamber 22 and the carburizing zone 23. It is accordingly made possible to maintain mutually different ambient atmospheres and temperatures in the purge chamber 21, the heating chamber 22, and the carburizing zone 23.

The roller hearth 10 comprises a plurality of hearth rollers 10A, and a motor not shown in the figures which supplies rotation to this plurality of hearth rollers 10A. The plurality of hearth rollers 10A are arranged at approximately equal intervals so as to constitute a floor surface from a portion of the diffusion zone 24 on its downstream side via the cooling zone 25 to a portion of the quenching device 11 on its upstream side. Both end portions of each of these hearth rollers 10A are passed through the side walls of the furnace main body 1 so as to be exposed to the exterior, and the shafts thereof are supported by bearings not shown in the figures. And the rotation of the motor is transmitted to the one end portions of each of these hearth rollers 10A.

The quenching device 11 comprises a lift mechanism 42 and an oil tank 43. The lift mechanism 42 comprises a lift stage 42B which is movable up and down, and which comprises a plurality of rollers 42A. A tray 200 which has been brought into the cooling zone 25 is mounted upon this lift stage 42B. The oil tank 43 is disposed below the conveyance path of the tray 200, and stores quenching oil. The lift mechanism 42 lowers the lift stage 42B with a tray 200 mounted upon it, and dips the tray 200 into the oil tank 43. Thereby workpieces which are loaded upon the tray 200 is abruptly cooled by the quenching oil.

The removal device 12 comprises a plurality of rollers 51 and a removal door 52. This plurality of rollers 51 constitutes a conveyance surface within the removal device 12 for a tray 200. The removal door 52 opens and closes a removal outlet 12A of this removal device 12 selectively.

Figure 3:
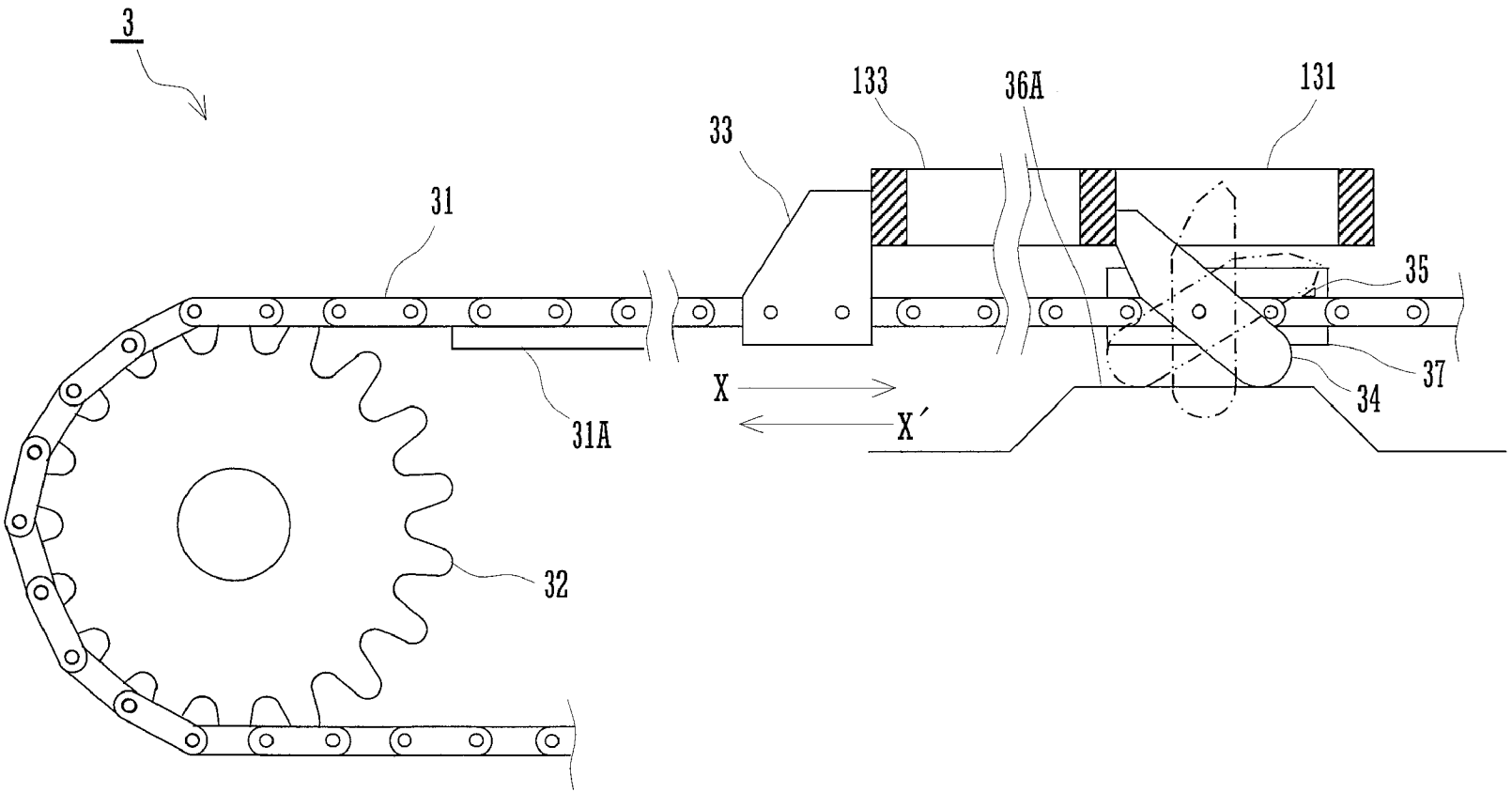
FIG. 3 is a side view of a pusher-puller device which is provided to this continuous carburizing furnace.

FIG. 3 is a side view of the pusher-puller device 3 which is provided to the above described continuous carburizing furnace. This pusher-puller device 3 comprises a link chain 31. The link chain 31 is meshed with a sprocket 32. The link chain 31 is shifted reciprocatingly to and fro along the direction of conveyance X and the return direction X', along guides 31A by the sprocket 32 being rotated by a motor not shown in the figures.

A projecting member 33 and a hook 34 are fixed to the link chain 31. The projecting member 33 faces towards the direction of conveyance X, and contacts against the upstream side end portion of that pallet 133 which is most towards the upstream side with respect to the direction of conveyance X. And the hook 34 is attached so as to be able to pivot freely, via a frame 37, at a position which is more downstream with respect to the direction of conveyance X than the position at which the projecting member 33 is fitted. Below the region where the hook 34 passes through the link chain 31, cam members 36A through 36C are disposed in fixed positions (in FIG. 3, the cam members 36B and 36C do not appear).

When the end portion of the hook 34 is not contacting against any one of the cam members 36A through 36C, then the hook 34 is in a state in which it can freely rotate from its neutral position shown by the single dotted broken line in FIG. 3. On the other hand, when the lower end portion of the hook 34 comes into contact against one of the cam members 36A through 36C during motion in the direction of conveyance X, then the hook 34 is rotated in the clockwise direction and comes to be positioned to its retract position as shown by the double dotted broken line in FIG. 3; while, when the lower end portion of the hook 34 comes into contact against one of the cam members 36A through 36C during motion in the return direction X', then the hook 34 is rotated in the anti-clockwise direction and comes to be positioned to its contacting position as shown by the solid line in FIG. 3. This hook 34 and the cam members 36A through 36C correspond to the "hook mechanism" of the Claims.

A stopper 35 is provided to the frame 37. This stopper 35 limits the range of pivoting of the hook 34 in the clockwise direction. And this stopper 35 is arranged so that a certain gap is left between it and the hook 34, when the lower end portion of the hook 34 is contacted against one of the cam members 36A through 36C during movement in the direction of conveyance. This is in order to permit the chain 31 to move upwards or downwards to a certain extent.

When the link chain 31 moves forward in the direction of conveyance X, then first the projecting member 33 contacts against the upstream side of the pallet 133 which is most towards the upstream side. When the forward movement of the link chain 31 in the direction of conveyance X is continued, by the pallet 133 contacting against the pallet 132 and the pallet 132 contacting against the pallet 131, the three pallets 131 through 133 come all to move together along the direction of conveyance X as a unit. And, while during this forward movement the hook 34 contacts against the cam members 36C through 36A in succession, it is pivoted between its neutral position and its retract position, but does not exert any influence upon the forward movement of the pallets 131 through 133.

And, when the link chain is shifted backwards in the reverse direction X' which is opposite to the direction of conveyance X, due to the lower end of the hook 34 coming into contact against the cam member 36A, it is rotated to its contacting position, and its upper end comes into contact with the pallet 131, so that the pallets 131 through 133 are shifted somewhat in the reverse direction X'. And, when the link chain 31 continues its shifting in the reverse direction X', then the lower end of the hook 34 ceases to contact against the cam member 36A, so that the upper end of the hook 34 pivots in the clockwise direction and ceases to contact against the pallet 131.

At this time, the shifting of the pallets 131 through 133 in the reverse direction X' stops. Moreover, when the shifting of the link chain 31 in the reverse direction X' continues, the lower end of the hook 34 comes into contact against the cam member 36B so that the hook 34 is rotated in the anti-clockwise direction, whereby its upper end comes into contact with the pallet 132 on the upstream side of the pallet 131.

Due to this, the shifting of the pallets 132 and 133 along the reverse direction X' is resumed. And, in the same manner as when during the reverse movement of the link chain 31 the hook 34 passes the cam member 36C, after the reverse movement of the pallets 132 and 133 is temporarily stopped, only the reverse shifting of the pallet 133 along the reverse direction X' is resumed.

By disposing the cam members 36A through 36C respectively beneath and between the heating chamber 22 and the carburizing zone 23, between the purge chamber 21 and the heating chamber 22, and between the introduction chamber 20 and the purge chamber 21, during the reverse movement of the link chain 31, it is possible to stop the pallets 131 through 133 respectively within the heating chamber 22, within the purge chamber 21, and within the introduction chamber 20.

FIGS. 4A through 4D are schematic side cross sectional views for explanation of the operation of the principal portions of this continuous carburizing furnace according to an embodiment of the present invention. In the following, the explanation will only focus attention upon the operations related to the intermediate doors 4 through 6 during the processing for bringing in the trays 200 to the introduction chamber 20, the purge chamber 21, the heating chamber 22, and the carburizing zone 23; and explanation of the operation of the other doors will be omitted.

Figure 4A:
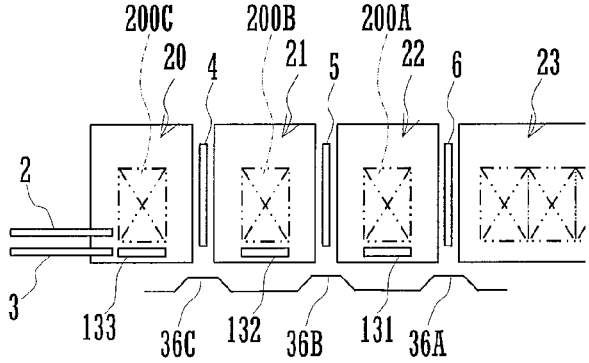
FIGS. 4A through 4D are schematic side cross sectional views for explanation of the operation of the principal portions of this continuous carburizing furnace.

Before a tray 200A is brought into the carburizing zone 23 from the heating chamber 22, as shown in FIG. 4A, a state holds in which trays 200A through 200C are housed respectively in the heating chamber 22, the purge chamber 21, and the introduction chamber 20, in the state of being respectively mounted upon pallets 131 through 133. The intermediate doors 4 through 6 are in their closed positions, so that they cut off the conveyance path at the positions where they are disposed.

Figure 4B:
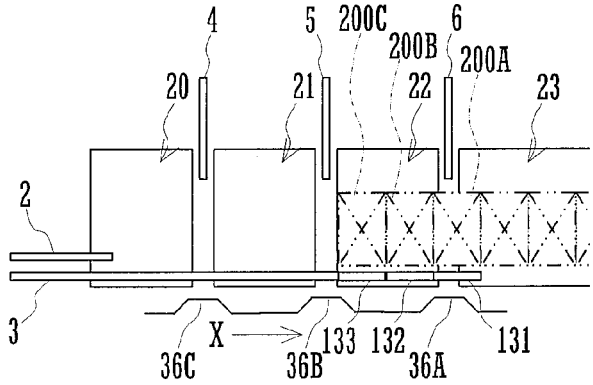

When the pre-heating processing of the workpiece loaded upon the tray 200A has been completed, and the tray 200A is to be brought into the carburizing zone 23 from the heating chamber 22, then, as shown in FIG. 4B, the intermediate doors 4 through 6 are shifted to their opened positions (i.e. are raised), and the pallet 133 is pushed along the direction of conveyance X by the pusher-puller device 3. And, by the pallet 133 contacting against the pallet 132 and the pallet 132 contacting against the pallet 131, all three of the pallets 131 through 133 are conveyed together along the direction of conveyance X. This shifting is continued until the tray 200A contacts against that tray 200 which is the one most to the upstream side which is stopped within the carburizing chamber 23.

Figure 4C:
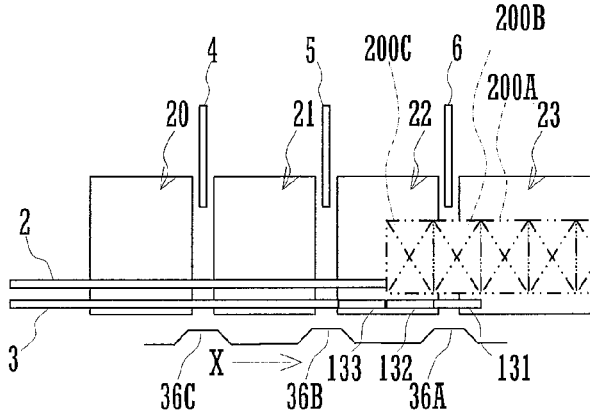

Next, as shown in FIG. 4C, the trays 200A through 200C are pushed along the direction of conveyance X using the pusher device 2. At this time, the pusher device 2 only pushes the trays 200A through 200C by the length of one tray 200. Due to this, the tray 200A arrives at a position within the carburizing zone 23 which is furthest towards the upstream side thereof. Furthermore, the trays 200B and 200C are shifted from being upon the pallets 132 and 133 respectively to being upon the pallets 131 and 132 respectively.

Figure 4D:
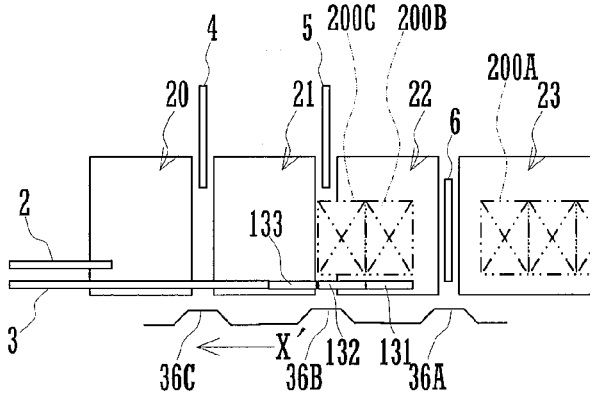

Subsequently, as shown in FIG. 4D, using the pusher-puller device 3, the pallets 131 through 133 are shifted all together along the reverse direction X'. And, due to the operation of the hook 34 and the cam members 36A through 36C as shown in FIG. 3, while stopping the pallets 131 and 132 in order within the heating chamber 22 and the purge chamber 21, the pusher-puller device 3 pulls back the pallet 133 to within the introduction chamber 20. At this time, the intermediate door 6, the intermediate door 5, and the intermediate door 4 are closed in that order. Since no tray 200 is mounted upon the pallet 133 which has been returned to within the introduction chamber 20, it is possible to mount the next tray 200 upon this pallet 133.

Due to the processing described above, while continuing to build the furnace 1 in a linear shape in plan view, it is possible to isolate the plurality of regions which are disposed on the upstream side of the carburizing zone 23 from one another, by using the intermediate doors 4 through 6.

Even with this configuration which allows a state in which it is possible to isolate the purge chamber 21 and the heating chamber 22 at the upstream side of the carburizing zone 23 in the conveyance path from one another, it is still possible to convey the plurality of trays 200 within the carburizing zone 23 in mutual contact. Accordingly it is possible, while shortening the overall length of the furnace and thereby making the area which it occupies more compact, to perform pre-processing in the purge chamber 21, pre-heating processing in the heating chamber 22, and carburizing processing in the carburizing zone 23, upon a large number of workpieces in a uniform manner.

Although, in the embodiment described above, the introduction chamber 20, the purge chamber 21, and the heating chamber 22 were arranged on the upstream side of the carburizing zone 23 in the conveyance path, the present invention is not to be considered as being limited to the case of performing processing in regions of these three types; it would also be acceptable to perform other types of processing in these three regions. Furthermore, it would also be possible to implement the present invention in the case of four or more regions being arranged in this manner, in a fashion similar to that described above. Moreover, it is not absolutely necessary to enclose the periphery of the introduction chamber 20 as in the embodiment described above; it would also be acceptable for this introduction chamber 20 to be open to the exterior.

Furthermore, by making the pusher device 2 as a link chain, it is possible to shorten the total length in the direction of conveyance X of this continuous carburizing furnace 100. Moreover, by making the pusher-puller device 3 as a rod, it is possible to anticipate a reduction in the cost of the device as a whole.

It should be understood that, in the above described explanation of embodiments of the present invention, all of the features are shown by way of example, and should not be considered as being limitative of the present invention. The scope of the present invention is not to be defined by any of the features of the embodiment described above, but only by the scope of the appended Claims. Moreover, equivalents to elements in the Claims, and variations within their legitimate and proper scope, are also to be considered as being included within the range of the present invention.

What is claimed is:

1. A continuous carburizing furnace, comprising:

a furnace which comprises a carburizing zone in which carburizing processing is performed upon workpieces loaded upon trays during the conveyance of said trays along a direction of conveyance, and a plurality of regions which are arranged successively along said direction of conveyance at the upstream side of said carburizing zone;

a plurality of pallets, the same in number as said plurality of regions, upon each of which one said tray is mounted, and which are movable to and fro along said direction of conveyance within a single plane;

a pusher device which pushes said trays along said direction of conveyance; and a pusher-puller device which, along with pushing said plurality of pallets all together forward along said direction of conveyance, also pulls each of said plurality of pallets backward into each of said plurality of regions.

2. A continuous carburizing furnace according to claim 1, further comprising a plurality of intermediate doors which selectively open or close between each adjoining pair of said plurality of regions, and between the one of said plurality of regions most on the downstream side and said carburizing zone respectively.

3. A continuous carburizing furnace according to claim 2, wherein: said plurality of regions are arranged in this order along said direction of conveyance: an introduction chamber in which the trays wait before the start of conveyance; a purge chamber in which the trays are isolated from the external air; and a heating chamber in which these workpieces are heated up to a preheating temperature which is lower than the carburizing temperature during said carburizing processing; and said plurality of pallets consists of three pallets upon which are mounted three trays which are to be respectively disposed in said introduction chamber, said purge chamber, and said heating chamber.

4. A continuous carburizing furnace according to claim 1, wherein said pusher-puller device comprises a projecting member which, when said plurality of pallets are moved forwards, contacts against that pallet among said plurality of pallets which is most to the upstream side along said direction of conveyance towards the downstream side in said direction of conveyance, and a hook mechanism which, as said plurality of pallets are moved backwards, sequentially changes over, at each of the boundary positions between said plurality of regions, its engagement to the next pallet among said plurality of pallets which is positioned more to the upstream side in said direction of conveyance.

5. A continuous carburizing furnace according to claim 1, wherein said pusher-puller device is built as a link chain.

* * * * *